US005533891A

United States Patent [19]

Pearl, II et al.

[11] Patent Number: 5,533,891

[45] Date of Patent: Jul. 9, 1996

[54] LOCKING MECHANISM FOR HAND TORCH REGULATORS

[75] Inventors: David S. Pearl, II; Frank G. Smith, both of Fort Lauderdale, Fla.

[73] Assignee: Uniweld Products, Inc., Fort Lauderdale, Fla.

[21] Appl. No.: 371,504

[22] Filed: Jan. 11, 1995

[51] Int. Cl.[6] ..... F23D 11/36

[52] U.S. Cl. ..... 431/154; 137/384; 137/382; 251/369

[58] Field of Search ..... 431/154; 137/383, 137/384, 382; 220/DIG. 33, 321, 320, 315, 724, 725, DIG. 34, DIG. 20; 251/297, 369

[56] References Cited

U.S. PATENT DOCUMENTS

| | | | |
|---|---|---|---|
| 4,013,395 | 3/1977 | Wormser | 431/9 |
| 4,732,559 | 3/1988 | Pearl, II et al. | 431/346 |
| 5,004,117 | 4/1991 | Kitsuda | 137/382 X |
| 5,035,195 | 7/1991 | Wille | 137/382 X |
| 5,160,065 | 11/1992 | Libes et al. | 137/382 X |
| 5,370,527 | 12/1994 | Hefling et al. | 126/39 R X |

OTHER PUBLICATIONS

Compressed Gas Association, Inc.; Connection No. 600; p. 55 "1.000–20 UNEF–RH–EXT" information sheet (no date).

*Primary Examiner*—Larry Jones
*Attorney, Agent, or Firm*—Nields & Lemack

[57] ABSTRACT

An automatic locking pressure regulator or valve for a fuel tank. The regulator or valve includes locking means which prevent loosening of the regulator or valve from a standard fuel cylinder valve outlet connection. In a preferred embodiment of the present invention, the locking mechanism is coupled to the base of the regulator or valve, and protrudes into the threads on the standard fitting on the fuel cylinder to prevent one-way rotation of the pressure regulator or valve.

11 Claims, 7 Drawing Sheets

LOCKING MECHANISM FOR HAND TORCH REGULATORS

BACKGROUND OF THE INVENTION

Combustion chambers for burning premixed fuels with air have various applications, but generally require the mixing of the fuel with an oxygen source such as air, igniting the mixture, and burning the mixture. One such application is in self-contained portable torches, which use pressurized gas tanks as the fuel source. The fuel is mixed with ambient air and flows through a jet ejector or nozzle. An example of such a portable torch is disclosed in U.S. Pat. No. 4,732,559, assigned to the instant assignee. This combustion device includes means for combining a fuel gas and a combustion supporting gas, and means for stalling the combined fuel gas and combustion supporting gas when the combined gases are moving either at a low velocity or a high velocity. Another fuel combuster is disclosed in U.S. Pat. No. 4,013, 395. That device uses a vortex generator as a flame holder, which results in a swirling flame.

Pressure regulators or valves are attached to a standard fitting on the outlet of the fuel tanks (such as propane or Mapp® gas) associated with such combustion devices, and regulate the amount of fuel flowing to the torch tip. However, such regulators are generally manually attach to the tank fitting by means of screw threads, and can come loose during operation. Since the gas in the fuel tank is highly flammable, and the torch tip in operation emits an open flame, a loose regulator can result in fires, or can cause severe burns to the operator.

It is therefore an object of the present invention to provide a fuel regulator which automatically locks onto a fuel tank.

It is a further object of the present invention to provide a combustion device including a regulator having a fuel tank locking mechanism.

These and other objects of the present invention will become apparent upon reference to the following description, drawings and claims.

SUMMARY OF THE INVENTION

The problems of the prior art have been overcome by the present invention, which provides a locking pressure regulator or valve for a fuel tank. The regulator or valve includes locking means which prevent loosening of the regulator or valve from a standard fuel cylinder valve outlet connection. In a preferred embodiment of the present invention, the locking mechanism is coupled to the base of the regulator or valve, and protrudes into the threads on the standard fitting on the fuel cylinder to prevent one-way rotation of the pressure regulator or valve.

DETAILED DESCRIPTION OF THE INVENTION

Figure 1:
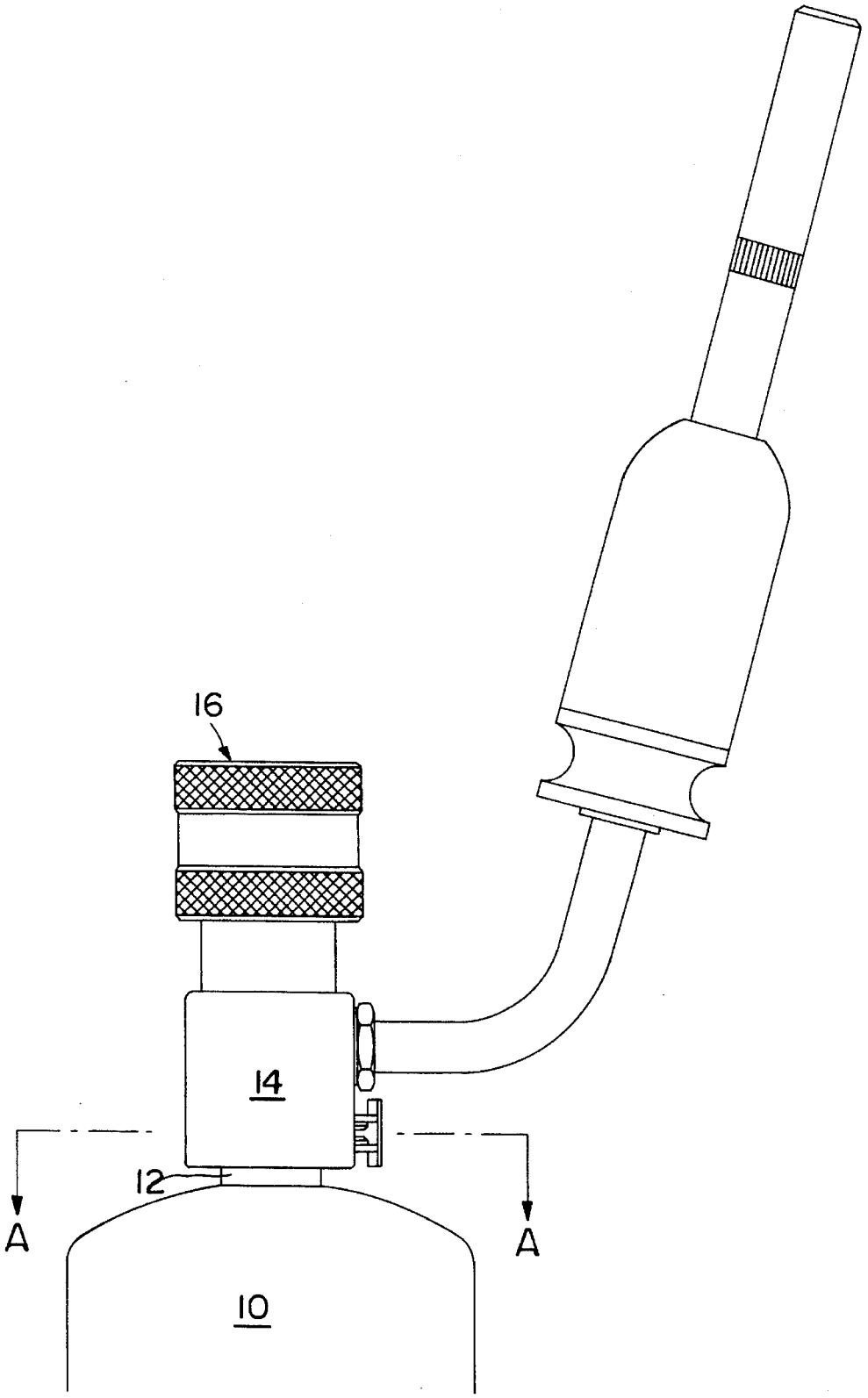
FIG. 1 is a front view of a regulator in accordance with the present invention shown attached to a fuel cylinder and having a torch tip.
Figure 2:
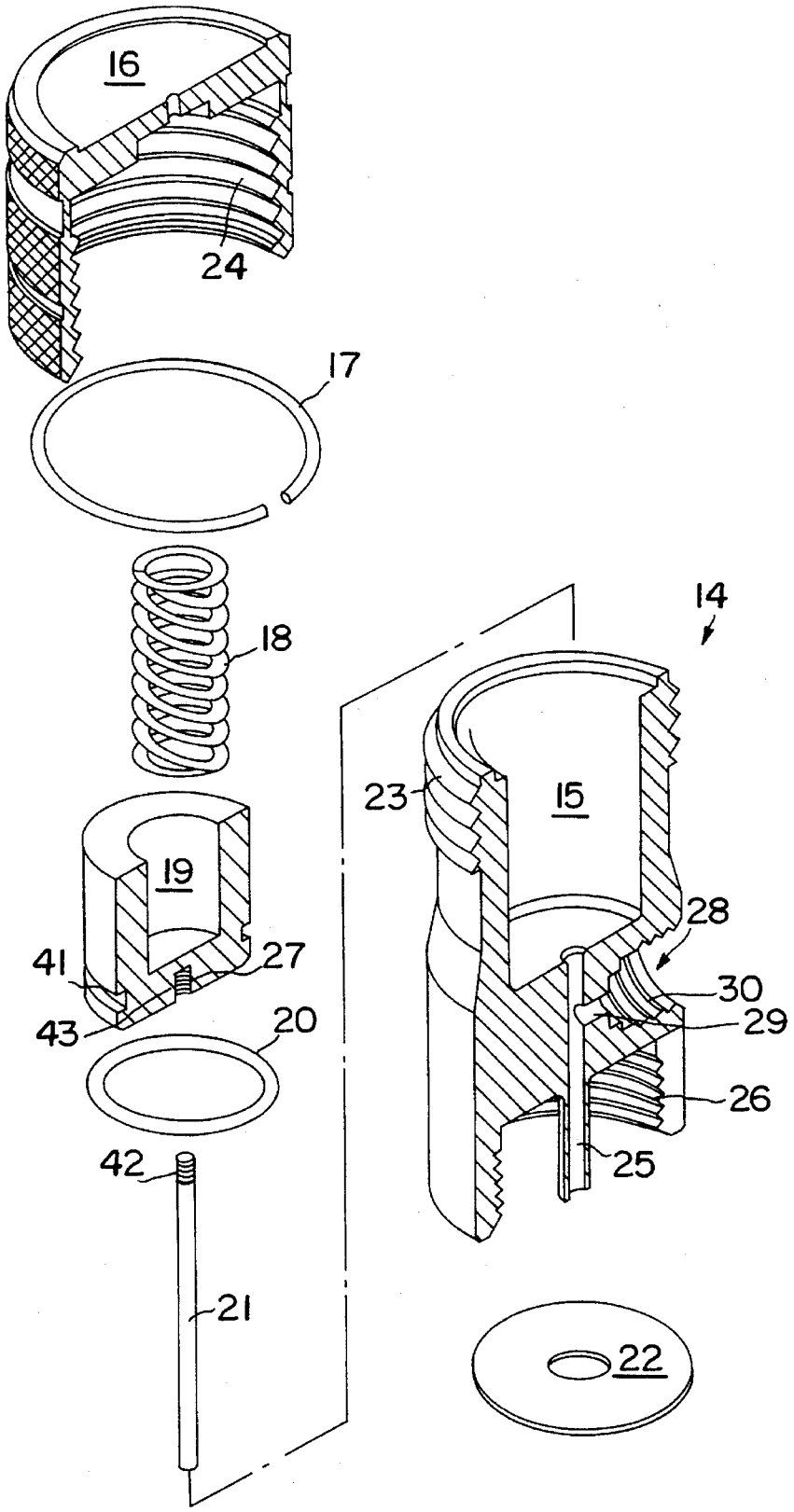
FIG. 2 is an exploded cutaway view of a conventional combustion device fuel regulator.

Turning now to FIGS. 1 and 2, there is shown a fuel cylinder 10 having a standard cylinder valve outlet connection 12, such as standard connection CGA-600, as detailed in Standard V1 available from Compressed Gas Association, Inc. Threadingly coupled to connection 12 is a conventional pressure regulator 14 having a base portion 15 and an on/off cap 16. It should be understood by those skilled in the art that any type of valve can be used, and reference to the particular pressure regulator detailed in this specification is by way of example only. Reference to FIG. 2 shows that regulator 14 includes cap 16 having internal threads 24, locking ring 17, spring 18, piston 19, O-ring 20, piston rod 21, base portion 15, and secondary seal 22. Base portion 15 has upper external threads 23 which mate with internal threads 24 on the cap 16, and lower internal threads 26 which mate with the external threads 70 on the fuel cylinder valve outlet connection. A central cylindrical bore 25 extends slightly below the internally threaded portion of the base 15 and receives piston rod 21. The upper end of piston rod 21 has external threads 42 which mate with internal threads 43 in bore 27 of piston 19, and the lower end of piston rod 21 extends out of bore 25 and is received by the fuel cylinder valve outlet connection 12. The piston 19 is sealed to wall of base portion 15 with O-ring 20 which fits in O-ring annular bore 41. Rotation of cap 16 causes vertical movement of piston 19, which in turn causes vertical movement of piston rod 21. In the "on" position, piston 21 projects out of the bore 25 and actuates a Schrader valve (not shown) in cylinder valve connection 12.

Figure 3:
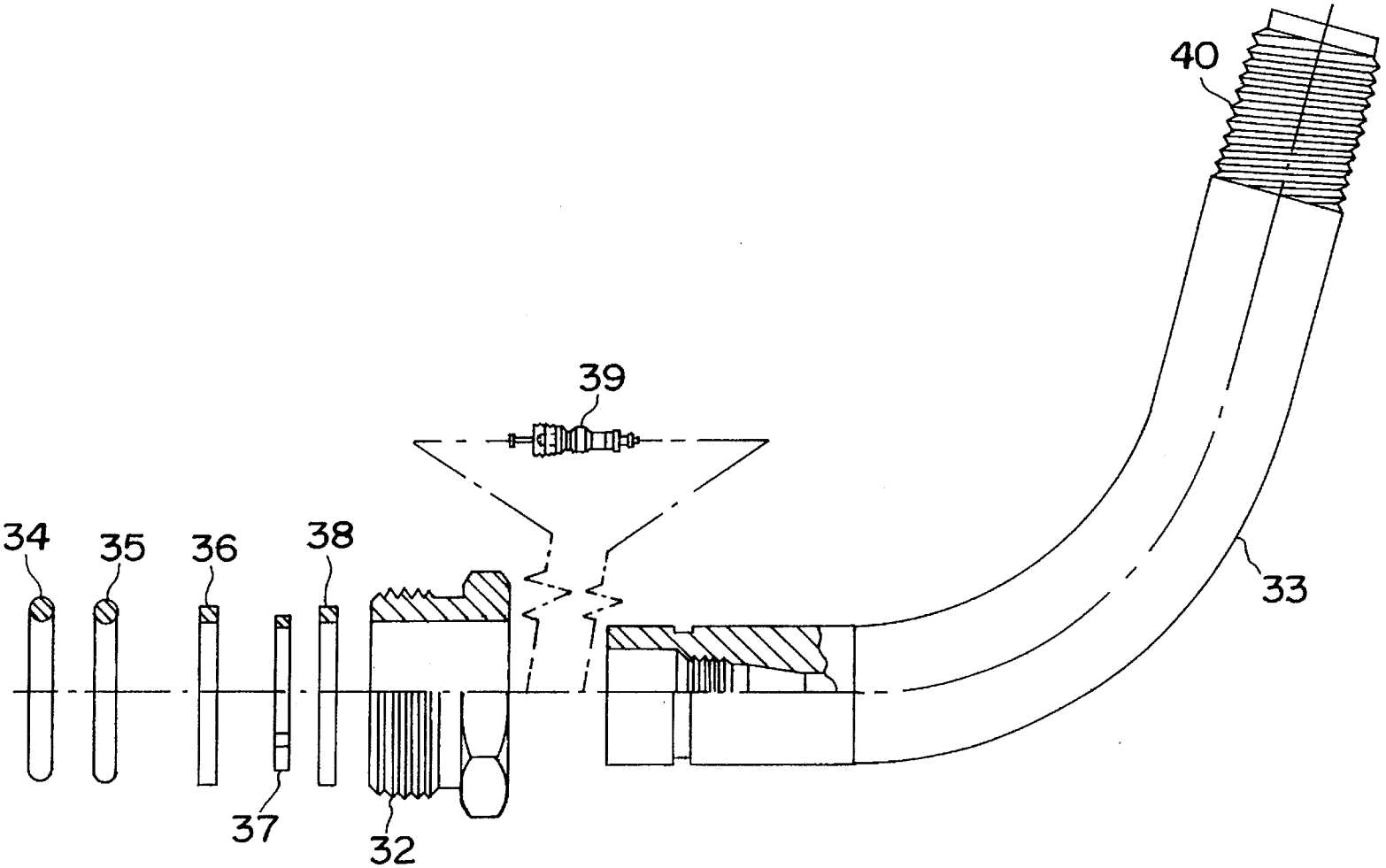
FIG. 3 is a side view, partially in section, of a torch tip elbow for use in the present invention.

Base portion 15 also includes an axial bore 28 which is in fluid communication with cylindrical bore 25 via passageway 29. Axial bore 28 includes internal threads 30 which mate with external threads 31 on packing nut 32 of torch tip outlet elbow 33 (FIG. 3). Elbow 33 is coupled to the base 15 through axial bore 28 via a pair of O-rings 34, 35, a washer 36, a snap ring 37 and a second washer 38. A Schrader valve 39 is housed in elbow 33 as shown. The upper end of elbow 33 has external threads which mate with a suitable torch tip, as shown in FIG. 1. When the regulator is turned to the "on" position, actuation of the Schrader valve in the cylinder valve connection 12 by piston rod 21 causes gas to flow in the cylindrical bore 25 around the piston rod 21, through passageway 29 and into the elbow 33 via axial bore 28. The spring 18 above the piston 19 compensates for the pressure created by the gas flow into the regulator, thereby providing smooth gas flow. Schrader valve 39 located in the elbow 33 forces the piston 19 up when the regulator is turned off.

Figure 4:
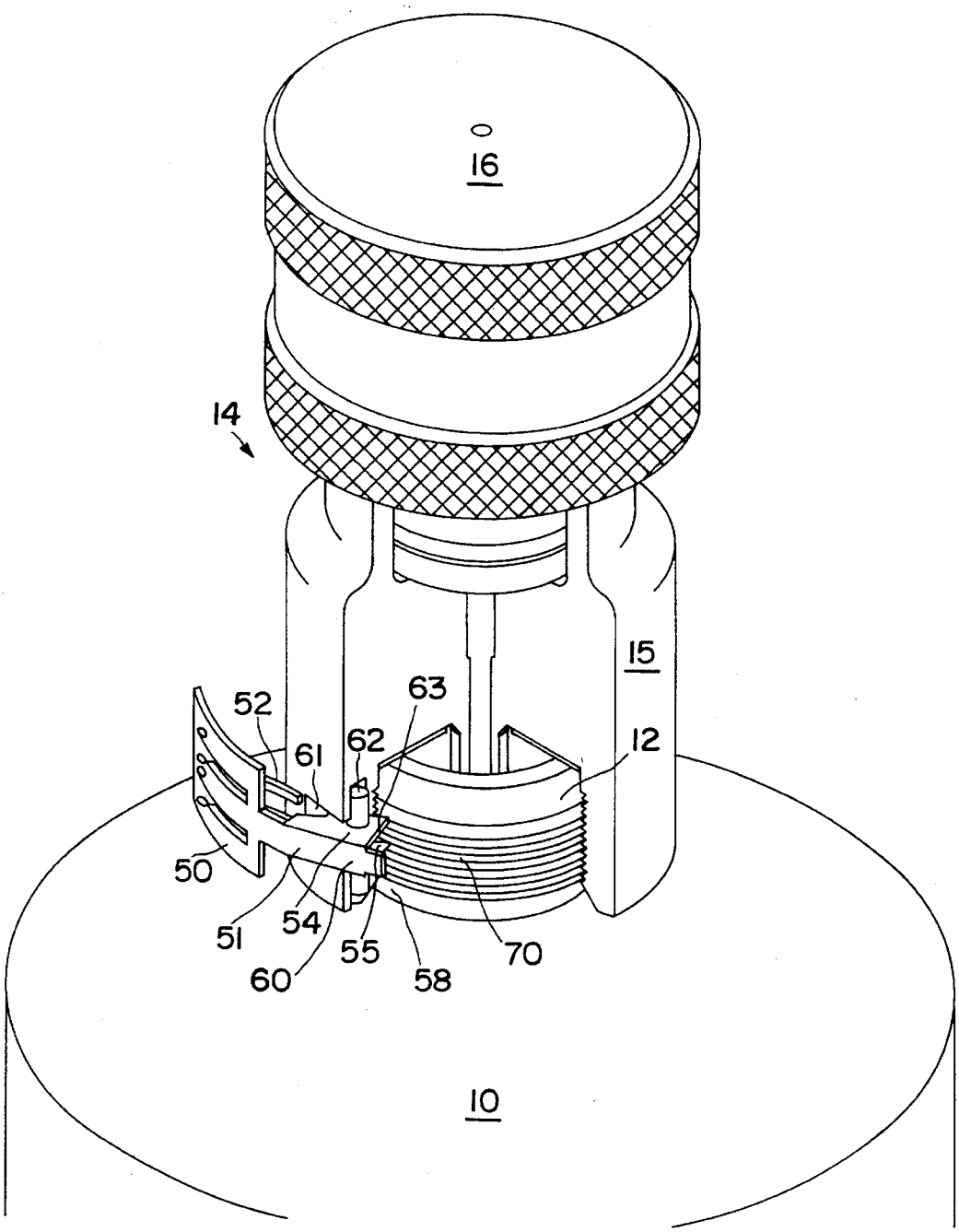
FIG. 4 is a cut-away view of the regulator assembled on a fuel cylinder and having the locking mechanism in accordance with the present invention.

Turning now to FIG. 4, there is shown the locking mechanism assembled in the base 15 of the regulator in accordance with a preferred embodiment of the present invention. Preferably the locking mechanism is fabricated from spring steel to provide flexibility. It includes curved face 50, shaped to conform to the cylindrical surface of the regulator 14, and hinge portion 51. The face 50 has one or more, preferably two, feet 52, 53 (only 52 shown), which can be cut-out from the face 50 and are bent away from the face for purposes to be described below.

Hinge portion 51 includes a base portion 60 and a pair of spaced parallel flaps 54, 55 extending in a direction substantially perpendicular to the base portion 60 in the direction away from the curved face 50. The end of each flap 54, 55 furthest from the curved face 50 terminates in a tooth 58, 59 (only one shown), each of which extends beyond the end of each flap 54, 55 closest to the curved face 50. Each flap 54, 55 has a pin hole 56, 57, respectively.

Figure 5:
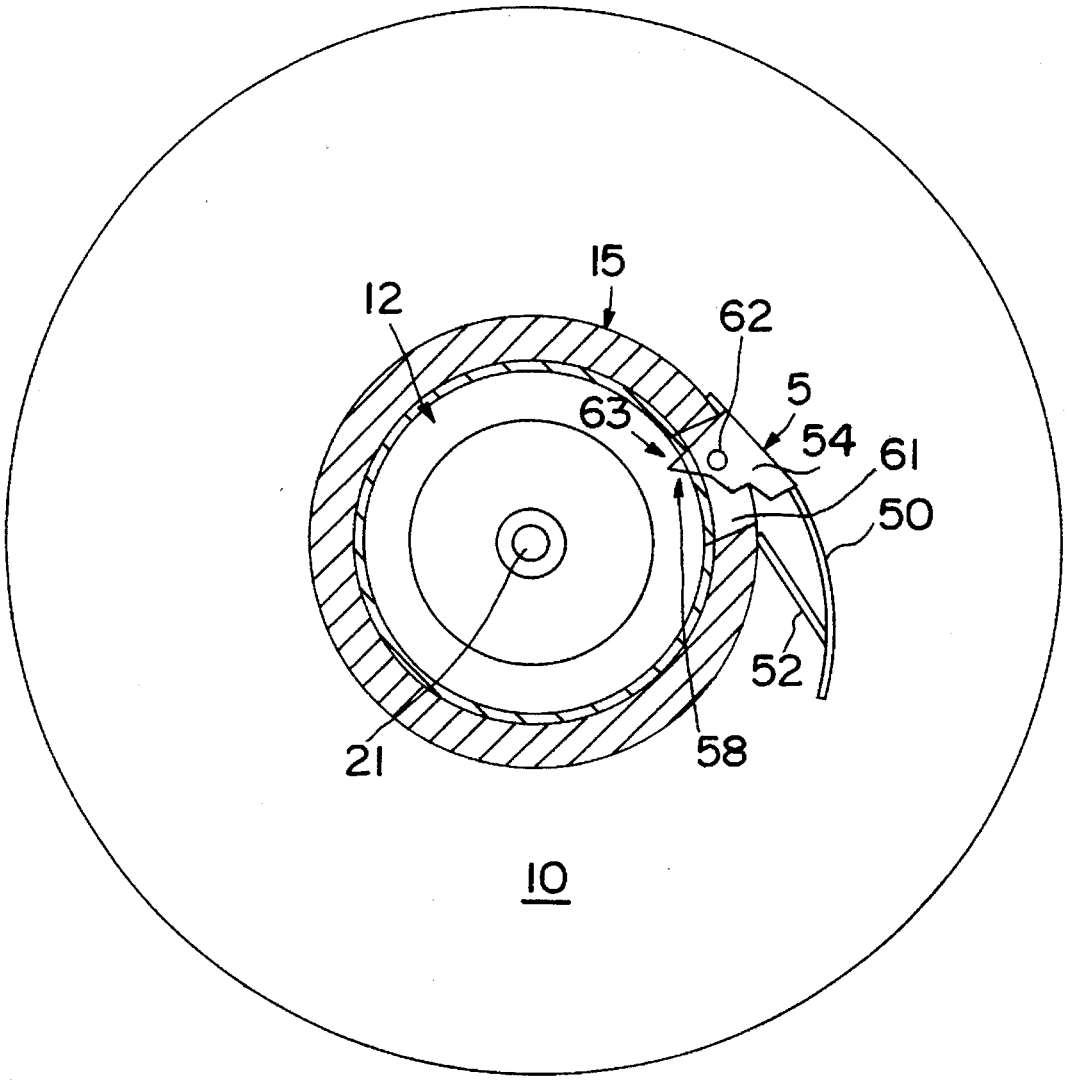
FIG. 5 is an exaggerated cross-sectional top view of a regulator coupled to a fuel cylinder in the locked position.

The base portion 15 of the regulator 14 includes a cut-out 61 appropriately dimensioned to receive the flaps 54, 55 of hinge portion 51. The cut-out 61 must be located along the internal threads 26 of base portion 15. A bore is formed from the bottom of the base portion 15 up through past the cut-out 61 to house a roll pin 62 that fits through pin holes 56, 57 in the flaps 54, 55. The roll pin 62 movably secures the locking mechanism in the cut-out 61. The flaps 54, 55 are so dimensioned that when the locking mechanism is secured in the cut-out 61, the teeth 58, 59 extend slightly beyond the internal threads 26 and into the cavity of the regulator base portion 15, and the back walls 63, 64 of flaps 54, 55 form a stop, as shown in slightly exaggerated form in FIG. 5. The locking mechanism is forced into the locked position via feet 52, 53, which press against the outer surface of the regulator base portion 15 as shown.

Figure 7:
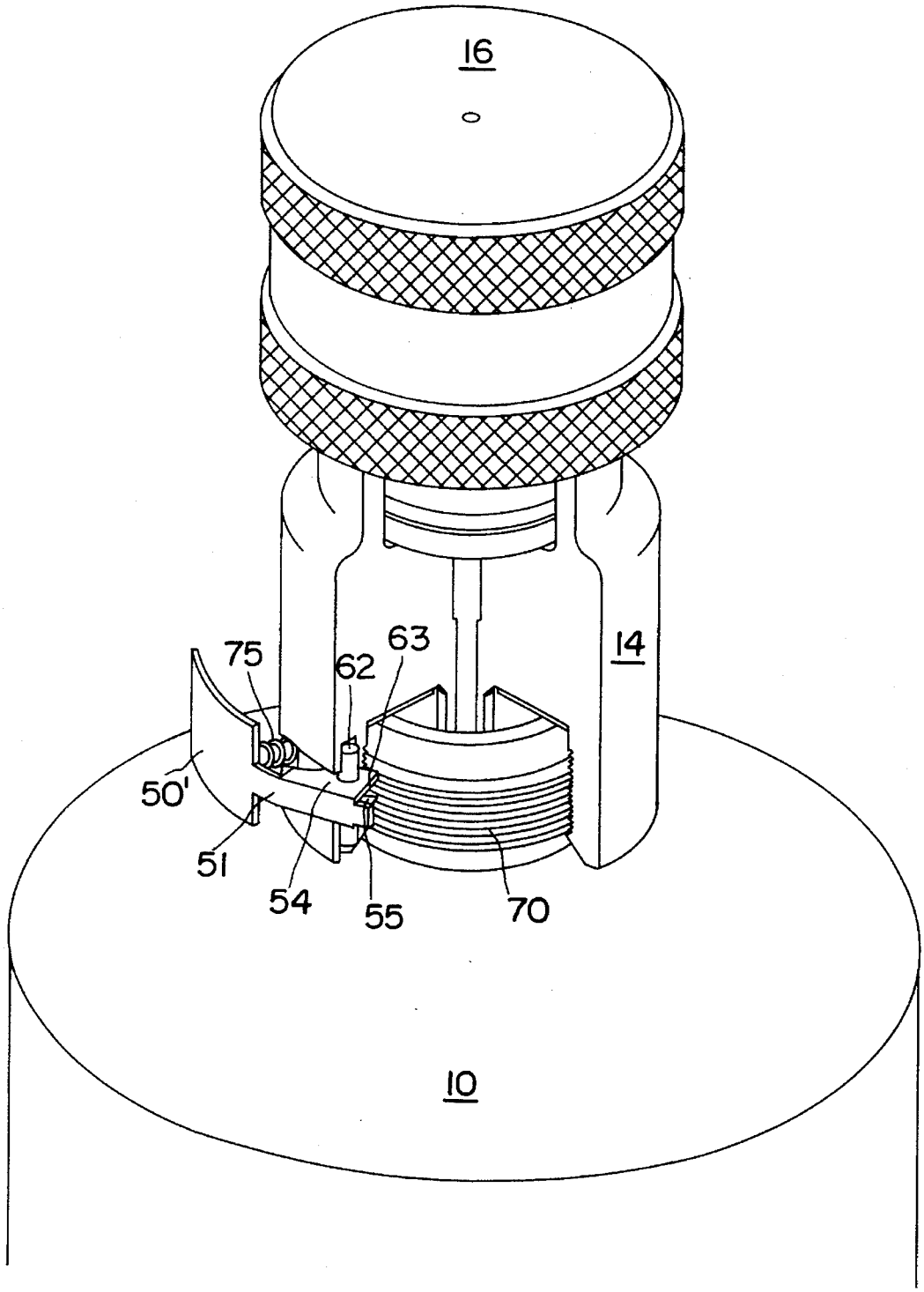
FIG. 7 is a cut-away view of the regulator assembled on a fuel cylinder and having a locking mechanism in accordance with an alternative embodiment of the present invention.

FIG. 7 shows an alternative embodiment of the locking mechanism, wherein a coil spring 75 is positioned between the regulator base portion 15 and the curved face 50' of the locking mechanism. Preferably the spring 75 is secured to the either the regulator base 15 or the curved face 50' or both, so that it is not lost during use. The spring acts in a manner similar to the feet 52, 53 of the preferred embodiment.

In operation (FIGS. 6A and 6B), the regulator 14 is coupled to the fuel cylinder 10 in the normal way; the locking mechanism does not interfere with this operation, since the angle of the teeth 58, 59 is such that the external threads 70 on the cylinder valve outlet connection 12 pass right by the teeth 58, 59 when the regulator is being screwed onto the connection 12. However, the reverse is not true; unscrewing of the regulator base portion 15 from connection 12 is prevented as the external threads 70 of connection 12 are jammed by the stop formed by the back walls 62, 64 of flaps 54, 55. Accordingly, the locking mechanism effectively prevents the regulator 14 from coming loose during operation of the torch tip.

Figure 6B:
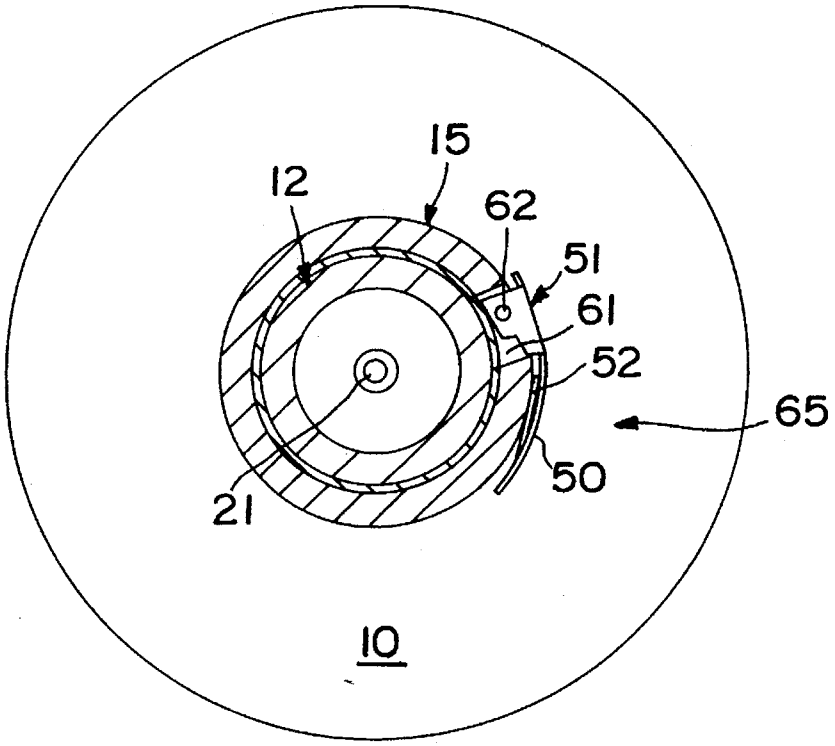
FIG. 6B is a cross-sectional top view of a regulator coupled to a fuel cylinder in the unlocked position, taken along lines A—A of FIG. 1.
Figure 6A:
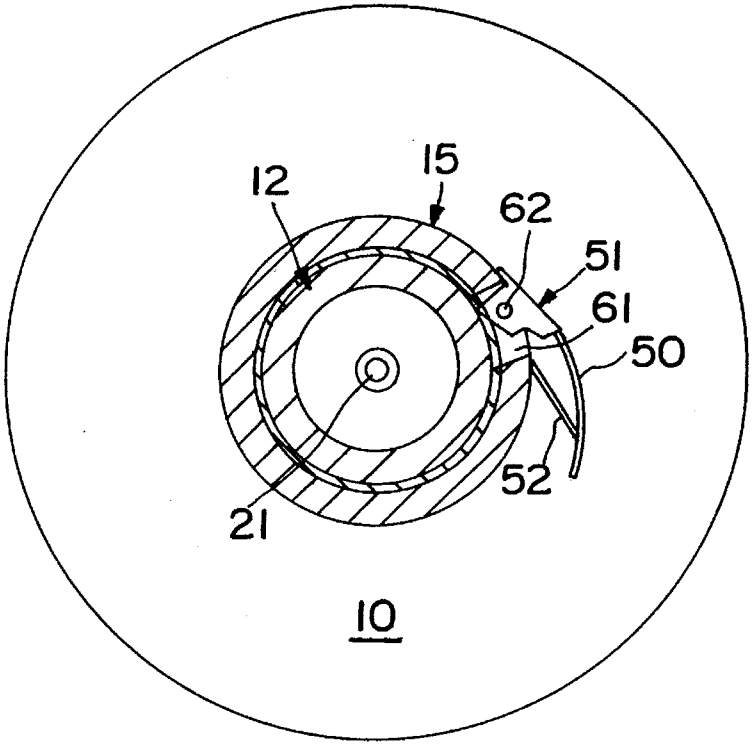
FIG. 6A is a cross-sectional top view of a regulator coupled to a fuel cylinder in the locked position, taken along lines A—A of FIG. 1.

To release the locking mechanism, a force is simply applied to the curved face 50 in the direction of arrow 65 as shown in FIG. 6B, which compresses feet 52, 53 (or spring 50' in the alternative embodiment) and causes retraction of the teeth 58, 59 from the cavity of the base portion 15. The regulator 14 then can be readily unscrewed from the connection 12 without the aforementioned jamming effect.

What is claimed is:

1. A gas burner comprising a source of gas having a threaded outlet connection valve and a gas valve coupled to said outlet connection valve, said gas valve comprising a base portion having locking means contacting the threads of said threaded outlet connection valve so as to prevent rotation of said gas valve in a direction which loosens said gas valve from said connection valve.

2. The gas burner of claim 1, wherein said locking means comprises a face portion and a hinge portion integral with said face portion, said hinge portion including a pair of flaps each terminating in a tooth.

3. The gas burner of claim 2, wherein said gas valve base portion includes a cavity, and wherein said hinge portion is movingly secured in said gas valve base portion such that each tooth extends into said cavity.

4. The gas burner of claim 1, wherein said locking means comprises spring means for biasing said locking means into contact with said threads.

5. A gas regulator comprising a base portion having a cavity; gas inlet means in said cavity for receiving a flow of gas; gas outlet means in communication with said gas inlet means for disseminating said gas to a torch tip coupled to said regulator; and locking means movably secured to said base portion, said locking means comprising a hinge portion having a pair of teeth extending into said cavity.

6. The gas regulator of claim 5, wherein said locking means further comprises spring means for forcing said teeth into said cavity.

7. The gas regulator of claim 6, wherein said locking means comprises a face portion, and wherein said spring means comprises a pair of feet extending from said face portion.

8. A pressure regulator for a fuel source having a threaded valve outlet connection, said pressure regulator comprising:

a base portion comprising an outer wall and an opening at its bottom end, said base portion having internal threads in said opening for removably coupling said pressure regulator to said threaded valve outlet connection of said fuel source;

an aperture through said outer wall; and locking means disposed in said aperture for preventing rotation of said pressure regulator in a direction which loosens said pressure regulator from said outlet connection.

9. The pressure regulator of claim 8, wherein said locking means comprises at least one projection having a first surface and a second surface, said first surface extending into said opening when in the locking position, said first surface configured and positioned in said opening in said locking position so as to allow said pressure regulator to be rotatingly threaded onto said threaded valve outlet connection, said second surface extending into said opening when in said locking position, said second surface configured and positioned in said opening in said locking position so as to prevent said pressure regulator from being rotatingly removed from said threaded outlet connection.

10. The pressure regulator of claim 9, wherein said locking means comprises spring means biasing said at least one projection into said opening.

11. The pressure regulator of claim 9, wherein said locking means is movable between a first locking position wherein said at least one projection extends into said opening, and a second unlocking position wherein said at least one projection is withdrawn from said opening.

* * * * *